US010377979B2

(12) United States Patent
Lundberg et al.

(10) Patent No.: US 10,377,979 B2
(45) Date of Patent: Aug. 13, 2019

(54) METHODS OF USING A SOIL RELEASE POLYMER IN A PREWASH COMPOSITION

(71) Applicant: Ecolab USA Inc., Saint Paul, MN (US)

(72) Inventors: Steven Lundberg, Saint Paul, MN (US); Jonathan P. Fast, Saint Paul, MN (US); Thomas Duerrschmidt, Hilden (DE); Thomas Merz, Hilden (DE); Jason Lang, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 15/861,412

(22) Filed: Jan. 3, 2018

(65) Prior Publication Data

US 2018/0127691 A1 May 10, 2018

Related U.S. Application Data

(63) Continuation of application No. 14/925,195, filed on Oct. 28, 2015, now Pat. No. 9,890,350.

(51) Int. Cl.

| | |
|---|---|
| ***C11D 11/00*** | (2006.01) |
| ***C11D 3/08*** | (2006.01) |
| ***C11D 3/00*** | (2006.01) |
| ***C11D 3/10*** | (2006.01) |
| ***C11D 3/30*** | (2006.01) |
| ***C11D 3/37*** | (2006.01) |

(52) U.S. Cl.

CPC ..... *C11D 11/0017* (2013.01); *C11D 3/0036* (2013.01); *C11D 3/08* (2013.01); *C11D 3/10* (2013.01); *C11D 3/30* (2013.01); *C11D 3/3715* (2013.01); *C11D 11/0064* (2013.01)

(58) Field of Classification Search

CPC ..... C11D 3/1246; C11D 3/1273; C11D 3/386; C11D 7/14; C11D 11/0017

See application file for complete search history.

(56) References Cited

U.S. PATENT DOCUMENTS

| | | | | |
|---|---|---|---|---|
| 3,962,152 | A | 6/1976 | Nicol | |
| 4,116,885 | A | 9/1978 | Derstadt | |
| 4,120,650 | A | 10/1978 | Kappler | |
| 4,125,370 | A | 11/1978 | Nicol | |
| 4,314,805 | A | 2/1982 | McKnight | |
| 4,908,039 | A * | 3/1990 | Holland | C11D 3/0036 427/220 |
| 4,999,869 | A | 3/1991 | Holland et al. | |
| 5,256,168 | A | 10/1993 | Morrall et al. | |
| 5,509,939 | A | 4/1996 | Kirchner | |
| 5,919,745 | A | 7/1999 | Cala et al. | |
| 6,080,713 | A | 6/2000 | Crutcher | |
| 6,200,351 | B1 | 3/2001 | Schleinig et al. | |
| 6,358,914 | B1 | 3/2002 | Gabriel | |
| 6,514,927 | B2 * | 2/2003 | Lang | C11D 1/37 510/357 |
| 6,579,837 | B1 * | 6/2003 | Fleury | C08G 63/672 510/299 |
| 7,381,226 | B2 | 6/2008 | Cooke et al. | |
| 7,553,807 | B2 | 6/2009 | Arai et al. | |
| 7,594,971 | B2 | 9/2009 | Michels et al. | |
| 8,034,123 | B2 | 10/2011 | Penninger | |
| 8,389,460 | B2 | 3/2013 | Arai et al. | |
| 8,900,328 | B2 | 12/2014 | De Buzzaccarini et al. | |
| 2003/0046775 | A1 | 3/2003 | Deak et al. | |
| 2005/0009724 | A1 | 1/2005 | Arredondo et al. | |
| 2005/0124521 | A1 * | 6/2005 | Sadlowski | D06F 35/006 510/295 |
| 2006/0123561 | A1 | 6/2006 | Wang et al. | |
| 2009/0186796 | A1 | 6/2009 | Gomez Ruiz et al. | |
| 2009/0274634 | A1 | 11/2009 | Collins et al. | |
| 2010/0139712 | A1 | 6/2010 | Hsu et al. | |
| 2010/0229312 | A1 | 9/2010 | De Buzzaccarini et al. | |
| 2011/0098418 | A1 * | 4/2011 | Morschhaeuser | C08G 63/672 525/437 |
| 2011/0197465 | A1 | 8/2011 | Byrne et al. | |
| 2011/0239379 | A1 | 10/2011 | Hodge et al. | |
| 2013/0000052 | A1 | 1/2013 | Peeters et al. | |
| 2013/0047345 | A1 | 2/2013 | Fast et al. | |
| 2014/0069466 | A1 | 3/2014 | Silvernail et al. | |
| 2014/0148374 | A1 | 5/2014 | Man et al. | |

FOREIGN PATENT DOCUMENTS

| | | | |
|---|---|---|---|
| BE | 867039 | A1 | 11/1978 |
| DE | 19548843 | A1 | 7/1997 |
| EP | 0028143 | B1 | 9/1983 |

(Continued)

OTHER PUBLICATIONS

Solvay, "Repel-O-Tex SF2", Product Data Sheet, available at www.rhodia-novecare.com, 1 page, Dec. 2012. Dec. 1, 2012. European Patent Office, "Extended European Search Report", issued in connection to International Application No. 16860898.2-1105 dated Apr. 3, 2019.

* cited by examiner

*Primary Examiner* — Charles I Boyer
(74) *Attorney, Agent, or Firm* — McKee, Voorhees & Sease, PLC

(57) ABSTRACT

The invention provides methods of cleaning including the use of a soil release polymer. In some embodiments, the soil release polymer can be included in a neutral to low alkalinity prewash or main wash that is substantially free of hydroxide-based alkalinity. In some embodiments, the soil release polymer can be included in a neutral to low alkalinity prewash that is substantially free of hydroxide-based alkalinity, followed by an alkaline main wash with any alkalinity source.

8 Claims, No Drawings

(56) References Cited

FOREIGN PATENT DOCUMENTS

| | | | |
|---|---|---|---|
| EP | 0235686 | A | 9/1987 |
| EP | 0375022 | A2 | 6/1990 |
| EP | 0753570 | A2 | 1/1997 |
| EP | 0995791 | A1 | 4/2000 |
| EP | 1216735 | A2 | 6/2002 |
| EP | 2287318 | A1 | 2/2011 |
| EP | 2135931 | B1 | 12/2012 |
| GB | 1466639 | | 3/1977 |
| GB | 2303146 | A | 2/1997 |
| GB | 2303150 | A | 2/1997 |
| JP | 2004196901 | A | 7/2004 |
| WO | 9423010 | A1 | 10/1994 |
| WO | 9732959 | A1 | 9/1997 |
| WO | 9950380 | A1 | 10/1999 |
| WO | 0006683 | A1 | 2/2000 |
| WO | 0043476 | A2 | 7/2000 |
| WO | 0231093 | A1 | 4/2002 |
| WO | 03008525 | A1 | 1/2003 |
| WO | 03014458 | A1 | 2/2003 |
| WO | 03089558 | A1 | 10/2003 |
| WO | 2004069972 | A1 | 8/2004 |
| WO | 2004074419 | A2 | 9/2004 |
| WO | 2004113390 | A1 | 12/2004 |
| WO | 2006040189 | A1 | 4/2006 |
| WO | 2007101470 | A1 | 9/2007 |
| WO | 2008148420 | A1 | 11/2008 |
| WO | 2009026956 | A1 | 3/2009 |
| WO | 2009061379 | A2 | 5/2009 |
| WO | 2010057977 | A1 | 5/2010 |
| WO | 2010107640 | A1 | 9/2010 |
| WO | 2010128337 | A2 | 11/2010 |
| WO | 2011024094 | A2 | 3/2011 |
| WO | 2011089493 | A2 | 7/2011 |
| WO | 2013060706 | A1 | 5/2013 |
| WO | 2013143576 | A1 | 10/2013 |
| WO | 2014085271 | A1 | 6/2014 |
| WO | 2014124927 | A2 | 8/2014 |

METHODS OF USING A SOIL RELEASE POLYMER IN A PREWASH COMPOSITION

CROSS-REFERENCE TO RELATED APPLICATIONS

This application is a Continuation Application of U.S. Ser. No. 14/925,195 filed Oct. 28, 2015, which is herein incorporated by reference in its entirety.

FIELD OF THE INVENTION

The invention relates to methods of using soil release polymers in laundry methods. In particular, use of soil release polymers in a pre-wash step that is substantially free of hydroxide-based alkalinity.

BACKGROUND OF THE INVENTION

Washing clothes in an industrial setting has many challenges that are not typically encountered in most domestic and commercial settings. For example, in some industrial settings the workers are in contact with machinery on a regular basis, which can make their clothes or uniforms soiled with oils and grease from those machines. In many instances, the clothing can be highly soiled. Accordingly, in certain industrial cleaning settings it is necessary to use more aggressive cleaning conditions as typical detergents, such as basic emulsion detergents, are not able to remove such oils effectively.

One alternative method of dealing with oil and grease that is commonly employed in commercial and domestic settings is the use of soil-release polymers (SRPs). SRPs are polymers that are able to bind to the fibers of clothing and prevent or reduce the amount of soils such as oil and grease from adhering to those fibers. SRPs can be effective at improving the removal of oily soils from synthetic fabrics in a laundry wash process. However, SRPs are not compatible with a typical industrial wash formula due to the highly alkaline main wash step—hydroxide-based alkaline step. Conventional SRPs possess a polyester backbone which is believed to be hydrolyzed in highly alkaline environments. In consumer laundry where the pH is generally near neutral, this is not an issue. But most industrial laundry uses a high alkaline step to help remove and suspend the industrial soils. Within the industry, it is typical to have a high alkaline prewash with hydroxide-based alkali, followed by detergent in a later step (see, for example, Riggs, Charles L. et al., "Bar Mops Formula," *Textile Laundering Technology* TSRA Handbook). Therefore, for use in industrial wash processes it would be desirable to use a high alkaline step and a soil release polymer in a way in which it is still effective. There have been attempts to remedy this problem, which have included, for example, in U.S. Pat. No. 6,200,351, the use of SRPs in a prewash step of an industrial washing method. What the '351 patent did not anticipate is that if soil release polymers are used in a prewash step which contains a hydroxide-based alkaline source (caustic alkalinity), the most common alkali used within the industry, the polymers are completely ineffective.

Therefore, there exists a need for improved cleaning compositions that can provide the required high level of cleaning in industrial applications. Further, there is a need to find viable cleaning methods for using SRPs in an industrial wash setting.

Accordingly, it is an objective of the claimed invention to provide a method for removing oily and/or greasy soils in an industrial was setting.

A further object of the invention is to methods of cleaning oily and/or greasy soils with the use of a SRP.

Other objects, advantages and features of the present invention will become apparent from the following specification taken in conjunction with the accompanying drawings.

BRIEF SUMMARY OF THE INVENTION

An advantage of the invention is to provide methods for using soil release polymers where the effect of the soil release polymers is retained in a laundry method. The present invention employs methods of using soil release polymers in a manner different from those conventionally used in the industry.

In embodiments, the methods of the invention include use of a soil release polymer in a neutral to low alkalinity prewash or main wash that is substantially free of hydroxide-based alkalinity. In embodiments, the methods of the invention include use of a soil release polymer in a neutral to low alkalinity prewash that is substantially free of hydroxide-based alkalinity, followed by an alkaline main wash with any alkalinity source. Embodiments of the invention can include use of the soil release polymers in a prewash step in a booster composition.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The present invention relates to the use of soil release polymers in laundry methods. The laundry methods of the invention have many advantages over existing laundry methods. For example, the present laundry methods provide for the effective use of soil release polymers. This allows for the effective removal of oily and greasy soils and is particularly beneficial for the industrial laundry setting.

The embodiments of this invention are not limited to particular detergent compositions, detergent boosters, surfactant boosters, or other laundry compositions provided that the methods of the invention are followed. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g., 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

As used herein, the term "alkyl" or "alkyl groups" refers to saturated hydrocarbons having one or more carbon atoms, including straight-chain alkyl groups (e.g., methyl, ethyl, propyl, butyl, pentyl, hexyl, heptyl, octyl, nonyl, decyl, etc.), cyclic alkyl groups (or "cycloalkyl" or "alicyclic" or "carbocyclic" groups) (e.g., cyclopropyl, cyclopentyl, cyclohexyl, cycloheptyl, cyclooctyl, etc.), branched-chain alkyl groups (e.g., isopropyl, tert-butyl, sec-butyl, isobutyl, etc.), and alkyl-substituted alkyl groups (e.g., alkyl-substituted cycloalkyl groups and cycloalkyl-substituted alkyl groups).

Unless otherwise specified, the term "alkyl" includes both "unsubstituted alkyls" and "substituted alkyls." As used herein, the term "substituted alkyls" refers to alkyl groups having substituents replacing one or more hydrogens on one or more carbons of the hydrocarbon backbone. Such substituents may include, for example, alkenyl, alkynyl, halogeno, hydroxyl, alkylcarbonyloxy, arylcarbonyloxy, alkoxycarbonyloxy, aryloxy, aryloxycarbonyloxy, carboxylate, alkylcarbonyl, arylcarbonyl, alkoxycarbonyl, aminocarbonyl, alkylaminocarbonyl, dialkylaminocarbonyl, alkylthiocarbonyl, alkoxyl, phosphate, phosphonato, phosphinato, cyano, amino (including alkyl amino, dialkylamino, arylamino, diarylamino, and alkylarylamino), acylamino (including alkylcarbonylamino, arylcarbonylamino, carbamoyl and ureido), imino, sulfhydryl, alkylthio, arylthio, thiocarboxylate, sulfates, alkylsulfinyl, sulfonates, sulfamoyl, sulfonamido, nitro, trifluoromethyl, cyano, azido, heterocyclic, alkylaryl, or aromatic (including heteroaromatic) groups.

In some embodiments, substituted alkyls can include a heterocyclic group. As used herein, the term "heterocyclic group" includes closed ring structures analogous to carbocyclic groups in which one or more of the carbon atoms in the ring is an element other than carbon, for example, nitrogen, sulfur or oxygen. Heterocyclic groups may be saturated or unsaturated. Exemplary heterocyclic groups include, but are not limited to, aziridine, ethylene oxide (epoxides, oxiranes), thiirane (episulfides), dioxirane, azetidine, oxetane, thietane, dioxetane, dithietane, dithiete, azolidine, pyrrolidine, pyrroline, oxolane, dihydrofuran, and furan.

An "antiredeposition agent" refers to a compound that helps keep suspended in water instead of redepositing onto the object being cleaned. Antiredeposition agents are useful in the present invention to assist in reducing redepositing of the removed soil onto the surface being cleaned.

As used herein, the term "cleaning" refers to a method used to facilitate or aid in soil removal, bleaching, microbial population reduction, and any combination thereof. As used herein, the term "microorganism" refers to any noncellular or unicellular (including colonial) organism. Microorganisms include all prokaryotes. Microorganisms include bacteria (including cyanobacteria), spores, lichens, fungi, protozoa, virinos, viroids, viruses, phages, and some algae. As used herein, the term "microbe" is synonymous with microorganism.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

As used herein, the term "soil" or "stain" refers to a non-polar oily substance which may or may not contain particulate matter such as mineral clays, sand, natural mineral matter, carbon black, graphite, kaolin, environmental dust, etc.

As used herein, the term "substantially free" refers to compositions completely lacking the component or having such a small amount of the component that the component does not affect the performance of the composition. The component may be present as an impurity or as a contaminant and shall be less than 0.5 wt. %. In another embodiment, the amount of the component is less than 0.1 wt. % and in yet another embodiment, the amount of component is less than 0.01 wt. %.

The term "water soluble" as used herein, means that the material is in water in the compositions. In general, the material should be soluble 25° C. at a concentration of 0.0001% by weight of the water solution and/or water carrier, preferably at 0.001%, more preferably at 0.01% and most preferably at 0.1%.

The term "weight percent," "wt-%," "wt.," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods of the present invention can comprise, consist essentially of, or consist of the steps, components, and ingredients of the present invention as well as other steps, components, and ingredients described herein. As used herein, "consisting essentially of" means that the methods can include additional steps, components, and ingredients, but only if the additional steps, components, and ingredients do not materially alter the basic and novel characteristics of the claimed methods.

Laundry Methods

The laundry methods of the invention include the use of SRPs. In an aspect of the invention, the SRPs can improve the removal of oily and greasy soils. This is particularly, beneficial in the industrial laundry setting. The SRPs are included in a pre-wash step that is substantially free of hydroxide-based alkalinity. In a preferred embodiment, the pre-wash step that is substantially free of hydroxide-based alkalinity employs the use of a silicate-based alkalinity source. In another preferred embodiment, the pre-wash step that is substantially free of hydroxide-based alkalinity is a neutral pre-wash step, which can be followed by a main wash step included hydroxide-based alkalinity.

Methods of the present invention include a prewash step, a main wash step, an optional sour step, and optional finishing steps. A traditional prewash step includes a composition containing a source of alkalinity, preferably sources that are also caustic. Specifically, traditional prewash steps include sources of alkalinity or a commonly caustic alkali so as to aid in removal and suspension of solids. Those alkalinity sources that are hydroxide-based create an environment in which SRPs are unstable. The prewash step of the present invention is thus substantially free of hydroxide-based alkalinity sources, while retaining the benefit of solids removal and suspension. The main wash step is conducted with a composition having sources of low alkalinity or neutral alkalinity, a surfactant, and optionally a booster. Preferably the main wash step is conducted with a composition having silicate-based alkalinity. Without seeking to be limited by a particular theory, it is thought that this composition is favorable as SRPs are most effective when they are utilized in stable form over multiple was cycles, as they then accumulate on the fabric.

Optionally, the methods of the present invention includes a souring step following removal of soils. This souring step is conducted with a composition that contains acid components that neutralize alkaline residues on the fabric while performing a sanitizing function. Additionally, the methods of the present invention may include other finishing steps such as softeners, bleaches, and/or starches.

Soil Release Polymers

Soil release polymers can be included in the methods of the invention. The polymers work by having both a hydrophobic monomer and a hydrophilic monomer that allow the SRP to adhere to polyester and polyester-blend fabric surfaces, making the surfaces more hydrophilic. By making the surfaces more hydrophilic the affinity of oily soils, like dirty motor oil, with polyester and polyester-blend fabrics is reduced which makes the soil easier to remove. This effect is greater when SRPs are used over multiple wash cycles, as the polymers are known to buildup on the fabric.

In an aspect of the invention, a soil release polymer contains at least one hydrophobic monomer and at least hydrophilic monomer, wherein the ratio of at least one hydrophobic monomer to at least one hydrophilic monomer is in the range of 1:2 to about 5:6. Preferably, the ratio is from 2:3 to 4:5. Preferably the ratio is 4:5.

In certain embodiments, during use, the hydrophobic monomers within the SRP may bind to fibers of fabric or textiles during the washing process, for example. Once the bound to a fiber, the SRP may prevent or hinder the adhesion of hydrophobic soils, such as grease or oils such as dirty motor oil. Thus fabrics that have been treated according to the methods herein may be more effectively cleaned, as the SRPs prevent hydrophobic soils from binding to the fibers of the fabric, or prevent at least the majority of hydrophobic soils from binding to the fibers of the fabric, or prevent at least some of hydrophobic soils from binding to the fibers of the fabric. The SRPs may hinder at least some hydrophobic soils from adhering or binding to the fibers of the fabric. Soils that adsorb to the fabric may be bound by the SRP and the SRP/soil agglomerate may desorb from the fabric, and the SRP may retain the soil in solution, thereby preventing re-deposition of the soil onto the fabric.

The SRP can include one or more of an ester, an ether, an acid, an alcohol, a heterogroup such as an amine, a sulphur group, or similar.

The hydrophobic monomer can include one or more of a saturated or unsaturated hydrocarbon chain, an aromatic ring, a substituted hydrocarbon chain or similar.

Preferred SRPs include, but are not limited to Repel-O-Tex crystal from Solvay, Texcare SRN 300 from Clariant, and Sorez 100 from Ashland.

In an aspect, the soil release polymer is utilized during the prewash step of the present invention. Additionally, the soil release polymer is utilized in the prewash step of the present invention, wherein the prewash step is of low or neutral alkalinity. In an aspect, the soil release polymer is utilized in the prewash step of the present invention, wherein the prewash step is substantially free of hydroxide-based alkalinity.

Alkalinity Source

In the methods of the invention a pre-wash step can be employed that is neutral, without any alkalinity source, or that is substantially free of hydroxide-based alkalinity. Further, in embodiments of the invention, the main wash step contains an alkalinity source, which can include hydroxide-based alkalinity sources. Thus, suitable alkalinity sources for use in the invention can include alkanol amines, carbonates, hydroxides, and silicates. In a preferred aspect of the invention, the alkalinity source is silicate-based.

Suitable alkanolamines include triethanolamine, monoethanolamine, diethanolamine, and mixtures thereof.

Suitable carbonates include alkali metal carbonates, such as sodium carbonate, potassium carbonate, bicarbonate, sesquicarbonate, and mixtures thereof.

Suitable hydroxides include alkali and/or alkaline earth metal hydroxides. Preferably, a hydroxide-based alkalinity source is sodium hydroxide. In some embodiments of the invention, the entire method of cleaning can be substantially free of hydroxide-based alkalinity sources.

Suitable silicates include metasilicates, sesquisilicates, orthosilicates, and mixtures thereof. Preferably the silicates are alkali metal silicates. Most preferred alkali metal silicates comprise sodium or potassium.

The alkalinity source can be present in the pre-wash step in amount that provides a pH between about 6.5 and about 10.5; preferably between about 7 and about 10, more preferably between about 7.5 and about 9.5. It was found that use of a pH that is too alkaline in the prewash step can detrimentally impact the SRP. Further, use of a pH that is too low will not provide the desired cleaning efficacy.

In an embodiment of the invention, the alkalinity source can be in the main wash step in an amount that provides a pH between about 8 and about 14; preferably between about 8.5 and 13; more preferably between about 9 and 12. In an alternative embodiment of the invention, the alkalinity source can be in the main wash step in an amount that provides a pH between about 7 and about 11; preferably between about 8 and about 10.5; more preferably between about 8.5 and about 10.

Carrier

The steps of the invention are typically performed with a carrier. Preferably the carrier is water, although in certain embodiments a different solvent can be used.

Surfactants

In some embodiments, the compositions of the present invention include a surfactant. Surfactants suitable for use with the compositions of the present invention include, but are not limited to, nonionic, anionic, cationic, amphoteric, and zwitterionic surfactants. In some embodiments, the compositions of the present invention include about 5 wt. % to about 50 wt. % of a surfactant. In other embodiments the compositions of the present invention include about 10 wt. % to about 40 wt. % of a surfactant. In still yet other embodiments, the compositions of the present invention include about 15 wt. % to about 35 wt. % of a surfactant. The class, identity, and number of surfactant(s) selected for use in the compositions and methods may be altered and selected based on the other components in the compositions and methods and based on the types of soils targeted for removal.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available from BASF Corp. One class of compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Another class of compounds are tetra-flinctional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Lutensol™, Dehydol™ manufactured by BASF, Neodol™ manufactured by Shell Chemical Co. and Alfonic™ manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Disponil or Agnique manufactured by BASF and Lipopeg™ manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

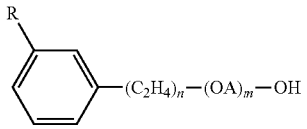

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkylene oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n$ $(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n$ $(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n$ $(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_S$N-$(EO)_t$H, $R^{20}$—$(PO)_S$N-$(EO)_t$H$(EO)_t$H, and $R^{20}$—N$(EO)_t$H; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—(PO)v-N[$(EO)_w$H][$(EO)_z$H] in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants. A preferred chemical of this class includes Surfonic™ PEA 25 Amine Alkoxylate. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

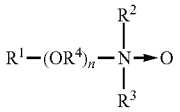

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

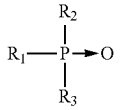

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

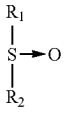

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, sulfonated fatty acids, such as sulfonated oleic acid, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

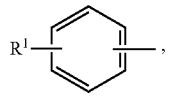

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

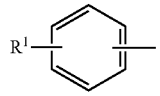

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

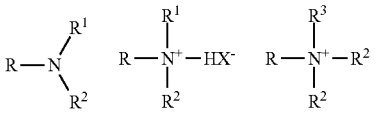

in which, R represents an alkyl chain, R', R", and R"' may be either alkyl chains or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

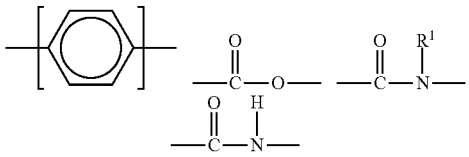

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

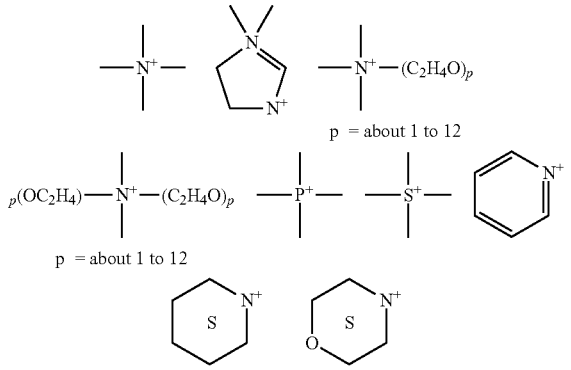

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

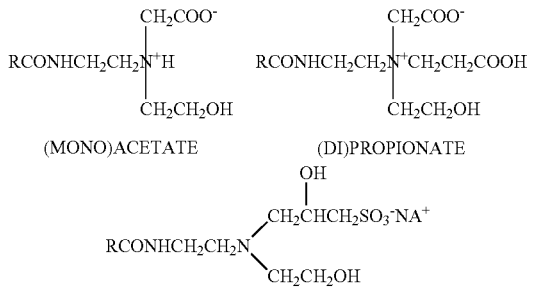

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong" inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

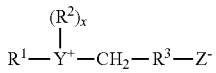

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxy propane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

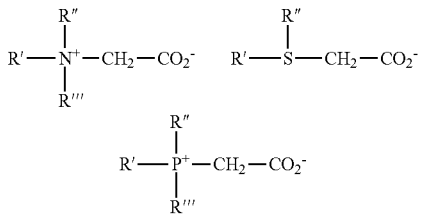

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated in their entirety.

Additional Functional Ingredients

The components employed in the methods can further be combined with various functional components suitable for use in laundry applications. The selection of these components may be influenced by the types of soils for removal and based on the other components employed to the compositions and methods. These additional functional components can be added to the pre-wash step, main wash step, a booster step, and/or a sour step.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically for laundry and textile cleaning applications.

In embodiments, the methods can include acids and acid sour agents, bleaching agents, enzymes and enzyme stabilizing agents, chelating agents and/or water conditioning agents, odorants and/or dyes, hydrotropes and/or couplers, optical brighteners, and solvents.

Acids and Acid Sour Agents

The methods of the invention can include an optional acid sour step after the main wash. The acid source step can be used to neutralize any residual alkalinity and to assist in stain and/or soil removal. It can be particularly helpful for the removal of certain soils and the removal and/or prevention of certain stains. Any suitable acid sour compositions can be employed. An acid sour step may be preferred in embodiments of the invention with a main wash step that includes hydroxide-based alkalinity.

Bleaching Agents

Suitable bleaches for use in the methods of the invention can be halogen-based bleaches or oxygen-based bleaches. However, oxygen-based bleaches are preferred.

If no enzyme material is present in the step or method, a halogen-based bleach may be effectively used as ingredient of the first component. In that case, said bleach is desirably present at a concentration (as active halogen) in the range of from 0.1 to 10%, preferably from 0.5 to 8%, more preferably from 1 to 6%, by weight. As halogen bleach, alkali metal hypochlorite may be used. Other suitable halogen bleaches are alkali metal salts of di- and tri-chloro and di- and tri-bromo cyanuric acids.

Suitable oxygen-based bleaches are the peroxygen bleaches, such as sodium perborate (tetra- or monohydrate), sodium percarbonate, hydrogen peroxide and peracids. These are preferably used in conjunction with a bleach activator which allows the liberation of active oxygen species at a lower temperature. Numerous examples of activators of this type, often also referred to as bleach precursors, are known in the art and amply described in the literature such as U.S. Pat. Nos. 3,332,882 and 4,128,494 herein incorporated by reference. Preferred bleach activators are tetraacetyl ethylenediamine (TAED), sodium nonanoyloxybenzene sulphonate (SNOBS), glucose pentaacetate (GPA), tetraacetylmethylene diamine (T AMD), triacetyl cyanurate, sodium sulphonyl ethyl carbonic acid ester, sodium acetyloxybenzene and the mono long-chain acyl tetraacetyl glucoses as disclosed in WO-91/10719, but other activators, such as choline sulphophenyl carbonate (CSPC), as disclosed in U.S. Pat. Nos. 4,751,015 and 4,818,426 can also be used.

Peracids suitable for the invention can be a single species or mixture. Suitable peracids can be selected based on the desired end use and based upon compatibility with other components in the compositions and methods. Preferred peracids include those having a carbon chain length of C2 to C12. Suitable peracids can include those described in U.S. Pat. No. 8,846,107, entitled, "In Situ Generation of Peroxycarboxylic Acids at Alkaline pH, and Methods of Use Thereof," which is expressly incorporated herein in its entirety by reference, including without limitation all drawings and chemical structures contained therein. Suitable peracids can include alkyl ester peroxycarboxylic acids, ester peroxycarboxylic acids, sulfoperoxycarboxylic acids, and others. Suitable alkyl ester peroxycarboxylic acids and ester peroxycarboxylic acids can include those described in U.S. Pat. Nos. 7,816,555 and 7,622,606, both entitled "Peroxycarboxylic Acid Compositions with Reduced Odor," hereby expressly incorporated herein in its entirety by reference, including without limitation all drawings and chemical structures contained therein. Suitable sulfoperoxycarboxylic acids can include those described in U.S. Pat. No. 8,809,392, entitled, "Sulfoperoxycarboxylic Acids, Their Preparation and Methods of Use as Bleaching and Antimicrobial Agents," which is expressly incorporated herein in its entirety by reference, including without limitation all drawings and chemical structures contained therein.

Peroxybenzoic acid precursors are known in the art as described in GB-A-836,988, herein incorporated by reference. Examples of suitable precursors are phenylbenzoate, phenyl p-nitrobenzoate, o-nitrophenyl benzoate, o-carboxyphenyl benzoate, pbromophenyl benzoate, sodium or potassium benzoyloxy benzene sulfonate and benzoic anhydride.

Preferred peroxygen bleach precursors are sodium p-benzoyloxy-benzene sulfonate, N,N,N,N-tetraacetyl ethylenediamine (TEAD), sodium nonanoyloxybenzene sulfonate (SNOBS) and choline sulfophenyl carbonate (CSPC).

The amounts of sodium perborate or percarbonate and bleach activator in the first component preferably do not exceed 30% respectively 10% by weight, e.g. are in the range of from 4-30% and from 2-10% by weight, respectively.

Chelating Agents/Water Conditioning Agents

Chelation herein means the binding or complexation of a bi- or multidentate ligand. These ligands, which are often organic compounds, are called chelants, chelators, chelating agents, and/or water conditioning agent. Chelating agents form multiple bonds with a single metal ion. Chelants, are chemicals that form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant. The chelants for use in the present invention are those having crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinse away and do not form a deposit.

Suitable chelating agents can be selected from the group consisting of amino carboxylates, amino phosphonates, polyfunctionally-substituted aromatic chelating agents and mixtures thereof. Preferred chelants for use herein are weak chelants such as the amino acids based chelants and preferably citrate, citrate, tararate, and glutamic-N,Ndiacetic acid and derivatives and/or phosphonate based chelants and preferably diethylenetriamine penta methylphosphonic acid.

Amino carboxylates include ethylenediaminetetra-acetates, N-hydroxyethylethylenediaminetriacetates, nitrilotriacetates, ethylenediamine tetraproprionates, triethylenetetraaminehexacetates, diethylenetriaminepentaacetates, and ethanoldi-glycines, alkali metal, ammonium, and substituted ammonium salts therein and mixtures therein. As well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), Nmethyliminodiacetic acid (MIDA), .quadrature.-alanine-N,N-diacetic acid (.quadrature.-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid is also suitable.

Other chelants include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis(methylenephosphonates) as DEQUEST. Preferred, these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfo benzene.

Further suitable polycarboxylates chelants for use herein include citric acid, lactic acid, acetic acid, succinic acid, formic acid all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

Defoaming Agents

Also useful in the compositions of the invention are wetting and defoaming agents. Wetting agents function to increase the surface contact or penetration activity of the antimicrobial composition of the invention. Wetting agents which can be used in the composition of the invention include any of those constituents known within the art to raise the surface activity of the composition of the invention.

Generally, defoamers which can be used in accordance with the invention include silica and silicones; aliphatic acids or esters; alcohols; sulfates or sulfonates; amines or amides; halogenated compounds such as fluorochlorohydrocarbons; vegetable oils, waxes, mineral oils as well as their sulfonated or sulfated derivatives; fatty acids and/or their soaps such as alkali, alkaline earth metal soaps; and phosphates and phosphate esters such as alkyl and alkaline diphosphates, and tributyl phosphates among others; and mixtures thereof.

In some embodiments, the compositions of the present invention can include antifoaming agents or defoamers which are of food grade quality given the application of the method of the invention. To this end, one of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as Ardefoam® from Armour Industrial Chemical Company which is a silicone bound in an organic emulsion; Foam Kill® or Kresseo® available from Krusable Chemical Company which are silicone and non-silicone type defoamers as well as silicone esters; and Anti-Foam A® and DC-200 from Dow Corning Corporation which are both food grade type silicones among others.

In some embodiments, the compositions of the present invention can include antifoaming agents or defoaming agents which are based on alcohol alkoxylates that are stable in acid environments and are oxidatively stable. To this end one of the more effective antifoaming agents are the alcohol alkoxylates having an alcohol chain length of about C8-12, and more specifically C9-11, and having poly-propylene oxide alkoxylate in whole or part of the alkylene oxide portion. Commercial defoamers commonly available of this type include alkoxylates such as the BASF Degressal's; especially Degressal SD20.

Dyes and Odorants

Various dyes, ordorants including perfumes, and other aestetic enhancing agents may also be included in compositions utilized in methods of the present invention, Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as CIS jasmine mj asmal, vanillin, and the like.

Enzymes and Enzyme Stabilizers

Embodiments of the invention can include the use of one or more enzymes. The one or more enzymes can comprise a protease. The one or more enzymes can comprise an amylase. In certain embodiments, the methods employ a protease and an amylase. The enzymes can be included in a cleaning composition in any step of the methods. In some preferred embodiments, the enzymes are in a booster composition used in the pre-wash step or in its own step.

When using enzymes, the methods of cleaning may also include the use of an enzyme stabilizing agent.

Hydrotropes/Couplers

A hydrotrope component can be used to help stabilize the surfactant component. It should be understood that the hydrotrope component is optional and can be omitted if it is not needed for stabilizing the surfactant component. In many cases, it is expected that the hydrotrope component will be present to help stabilize the surfactant component. Examples of the hydrotropes include the sodium, potassium, ammonium and alkanol ammonium salts of xylene, toluene, ethylbenzoate, isopropyl benzene, naphthalene, alkyl naphthalene sulfonates, phosphate esters of alkoxylated alkyl phenols, phosphate esters of alkoxylated alcohols, short chain ($C_8$ or less) alkyl polyglycoside, sodium, potassium and ammonium salts of the alkyl sarcosinates, salts of cumene sulfonates, amino propionates, diphenyl oxides, and disulfonates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of detergent composition.

Solvents

The composition can optionally include a solvent in any of the steps. The solvent can be selected based on the desired solubility in water and compatibility with other components. In certain embodiments a preferred solvent can include an alcohol or polyol. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g. propylene glycol, ethylene glycol, glycerine, and 1,2-propanediol) can also be used.

Methods of the Invention

As discussed above, use of SRPs is desirable for removal of certain soil types, particularly oily soils found in industrial laundry settings. The SRP can be useful in its direct treatment of soil on a textile and further can have a residual effect whereby it preventing adherence of soils later. Thus, in certain contexts it may be beneficial for the SRP to remain on a textile when the laundering is completed. However, it has been found that when paired with typical industrial laundering methods, the SRP does not retain its effective properties as the alkalinity hydrolyzes the SRP. Thus, under traditional industrial laundering methods the SRP is often hydrolyzed and is not as effective at removing soils in the laundry method and/or does not remain on the fabric for the residual effect that can prevent oils from adhering to the fabric.

This invention provides methods for cleaning laundry that include an SRP where the SRP's efficacy is retained and it remains effective in cleaning and optionally retains the residual effect. In some embodiments, the SRP can be included in a pre-wash step wash step that has a neutral to low pH (pH of about 6.5 to about 10.5) and is substantially free of hydroxide-based alkalinity, which can be followed by a main wash step with any type of alkalinity including, hydroxide-based alkalinity. In another embodiment, the SRP can be included in a main wash step that has neutral to low alkalinity (pH of about 6.5 to about to about 10.5) and that is substantially free of hydroxide based alkalinity.

In some embodiments of the invention, the SRP is included in a prewash step. The pre-wash step can include a detergent and/or booster. The pre-wash step can be neutral to low alkalinity having a pH between about 6.5 and about 10.5; preferably between about 7 and about 10, more preferably between about 7.5 and about 9.5. This can allow for adequate cleaning without injuring the SRP. When an alkalinity source is included in the prewash step, a preferred alkalinity source is a silicate.

When the SRP is included in a prewash step, the main wash step is typically an alkaline wash and can include any alkalinity sources, including, hydroxide-based alkalinity. Such a step can have a pH between about 8 and about 14; preferably between about 8.5 and 13; more preferably between about 9 and 12. However, in some embodiments, it is preferred to have a lower alkaline main wash step, i.e., having a pH from about 7.5 to about 11, preferably from about 8 to about 10.5, more preferably from about 8.5 to about 10. Such a wash step can be substantially free of hydroxide-based alkalinity. If the wash step is substantially free of hydroxide-based alkalinity, a preferred alkalinity source is a silicate. An advantage of having a main wash step with lower alkalinity is that the SRP's residual effect can be preserved.

In some embodiments of the invention, the SRP is included in the main wash step. If the SRP is included in the main wash step, the alkalinity of the main wash step has a pH from about 7.5 to about 11, preferably from about 8 to about 10.5, more preferably from about 8.5 to about 10. When an SRP is included in the main wash step, silicates are a preferred alkalinity source.

In some embodiments employing a booster, the booster can comprise the SRP and one or more of the following: one or more surfactants, one or more defoaming agents, one or more enzymes, and one or more enzyme stabilizers. In some preferred embodiments, a booster comprises, consists essentially of, or consists of an SRP and one or more surfactants. In some preferred embodiments, a booster comprises, consists essentially of, or consists of an SRP, one or more surfactants, and an enzyme. In some preferred embodiments, a booster comprises, consists essentially of, or consists of an SRP, one or more surfactants, a defoaming agent, and an enzyme.

Following the main wash step, finishing steps can optionally be included. Finishing steps can include the use of additional functional ingredients and/or booster compositions. A preferred finishing step is an acid sour step.

Between any of the wash steps and finishing steps there can be rinse steps. One or more rinse steps are preferred after the main wash step. In some embodiments, one or more rinse steps can be performed between a prewash step and a main wash step. If an acid sour step is employed, it is preferred that a rinse step follow it.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Three industrial wash processes, as indicated in Tables 1, 2, and 3 were evaluated comparing three different types of prewash steps. The wash processes were used over 5 consecutive cycles (with drying in between each cycle) in a 35 lb washer with 28 lb 65/35 poly cotton fill and 5 grain water. Chemistry was dosed equally in both wash studies as described in Tables 1, 2, and 3. Repel-O-Tex Crystal from Solvay was the soil release polymer used.

TABLE 1

Industrial wash process using an alkaline prewash

| | (Op/Drain) | | Example 1 - High Alkaline Prewash | |
|---|---|---|---|---|
| Operation | Time | Temp | Chemistry | Dose (oz/cwt) |
| PREWASH | 7/0 | 150 | Caustic Alkali | 14 |
| | | | Soil Release Polymer | 0.35 |
| MAIN WASH | 7/1 | 140 | Detergent | 7 |
| RINSE | 2/1 | 130 | | |
| RINSE | 2/1 | 115 | | |
| RINSE | 2/1 | 100 | | |
| SOUR | 4/1 | 85 | Acid Sour | 2 |
| LS EXTRACT | 3 | | | |
| SHAKEOUT | 1 | | | |

TABLE 2

Industrial wash processes using a neutral prewash

| | (Op/Drain) | | Example 2 - Neutral Prewash | |
|---|---|---|---|---|
| Operation | Time | Temp | Chemistry | Dose (oz/cwt) |
| PREWASH | 7/0 | 150 | Detergent | 7 |
| | | | Soil Release Polymer | 0.35 |
| MAIN WASH | 7/1 | 140 | Caustic Alkali | 14 |
| RINSE | 2/1 | 130 | | |
| RINSE | 2/1 | 115 | | |
| RINSE | 2/1 | 100 | | |
| SOUR | 4/1 | 85 | Acid Sour | 2 |
| LS EXTRACT | 3 | | | |
| SHAKEOUT | 1 | | | |

TABLE 3

Industrial wash process using a low alkaline prewash

| | (Op/Drain) | | Example 3 - Low Alkaline Prewash | |
|---|---|---|---|---|
| Operation | Time | Temp | Chemistry | Dose (oz/cwt) |
| PREWASH | 7/0 | 150 | Silicate Alkali | 10 |
| | | | Soil Release Polymer | 0.35 |
| MAIN WASH | 7/1 | 140 | Detergent | 7 |
| RINSE | 2/1 | 130 | | |
| RINSE | 2/1 | 115 | | |

TABLE 3-continued

| Industrial wash process using a low alkaline prewash | | | | |
|---|---|---|---|---|
| | (Op/Drain) | | Example 3 - Low Alkaline Prewash | |
| Operation | Time | Temp | Chemistry | Dose (oz/cwt) |
| RINSE | 2/1 | 100 | | |
| SOUR | 4/1 | 85 | Acid Sour | 2 |
| LS EXTRACT | 3 | | | |
| SHAKEOUT | 1 | | | |

Unsoiled, 100% polyester swatches available from wfk (30 A) were put through the wash process. A total of three swatches were removed after the drying in cycles 0, 1, 3, and 5. After all washes were complete all of the swatches from each cycle were soiled with 0.1 g of dirty motor oil. The stain was allowed to wick overnight on a flat surface and washed the following day using the same wash process as before. The percent of soil removal was calculated by measuring the reflectance of the soil on the swatches before and after wash on the spectrophotometer (ColorQuest XE, Hunter Associates Laboratory). The L* value is one of the color indices and is indicative of broad visible spectrum reflectance, where 100% is considered completely white. The % soil removal was calculated using the formula:

$$\% \ SR = \left(\frac{L^*_{Postwash} - L^*_{Prewash}}{96 - L^*_{Prewash}}\right) * 100.$$

Table 4 indicates the results of these calculations.

TABLE 4

| Percent soil removal of dirty motor oil after a series of washes using a soil release polymer in the prewash of an industrial wash process | | | |
|---|---|---|---|
| | % Soil Removal | | |
| Cycle Number | High Alkaline Prewash | Neutral Prewash | Low Alkaline Prewash |
| 0 | 32.56 | 27.74 | 27.70 |
| 1 | 35.49 | 36.64 | 28.93 |
| 3 | 36.44 | 51.00 | 46.96 |
| 5 | 38.08 | 60.63 | 52.63 |
| % Change from 0 to 5 | 16.95 | 118.60 | 90.02 |

In the method utilizing a high alkaline prewash, the soil release polymer provided no benefit in soil removal when applied over multiple cycles. In the other two methods, with a neutral prewash or a low alkaline prewash step, the soil release polymer provided a distinct benefit when applied over multiple cycles.

Example 2

Following the procedure set forth in Example 1, except that the swatches were soiled with 0.25 g of olive oil dyes with 0.05% sudan red, the industrial wash process of Table 5 was tested.

TABLE 5

| Food and beverage wash process using a neutral prewash | | | | |
|---|---|---|---|---|
| | (Op/Drain) | | Example 4 - F&B Neutral Prewash | |
| Operation | Time | Temp | Chemistry | Dose (oz/cwt) |
| FLUSH | 2/2 | 104 | | |
| PREWASH | 8/2 | 140 | Detergent Booster | 4.7 |
| | | | Soil Release Polymer | 1 |
| MAIN WASH | 12/2 | 140 | Detergent | 10 |
| | | | Caustic Alkali | 11.8 |
| BLEACH | 8/2 | 140 | Oxidizer | 5.5 |
| RINSE | 2/1 | 120 | | |
| RINSE | 2/1 | 110 | | |
| RINSE | 2/1 | 104 | | |
| FINISH | 4/1 | 104 | Acid Sour | 3.6 |
| EXTRACT | 4.5 | | | |

Table 6 indicates the calculated percent soil removal and indicates that the soil release polymer was also effective when it was added in a neutral prewash of a food and beverage linen process.

TABLE 6

| Percent Soil Removal of olive oil after a series of washes using a soil release polymer in a neutral prewash of a good and beverage was process. | |
|---|---|
| Cycle Number | % Soil Removal |
| 0 | 39.17 |
| 1 | 55.57 |
| 3 | 58.05 |
| 5 | 58.00 |
| % change from 0 to 5 | 48.07 |

Example 3

Two industrial wash main wash processes, shown in Tables 7 and 8, were evaluated comparing the two types of alkali as well as the doses of each individual alkali. The wash processes were used over 5 consecutive cycles, with drying in between each cycle, in a 35 lb washer with 28 lb 65/35 poly/cotton fill and 5 grain water. All chemistry other than the alkali was dosed equally in both wash studies described in Tables 7 and 8. Tables 9 and 10 show exemplary the alkali compositions. The detergent used comprised 5% Repel-O-Tex Crystal from Solvay.

TABLE 7

| Industrial Wash Processes Using a Silicate Alkalinity Source | | | | |
|---|---|---|---|---|
| | (Op/Drain) | | Hydroxide-Based Alkali | |
| Operation | Time | Temp | Chemistry | Dose (oz/cwt) |
| BREAK | 7/1 | 150 | Hydroxide-Based Alkali | 10-18 |
| CARRY OVER | 5/1 | 140 | Detergent | 7 |
| RINSE | 2/1 | 130 | | |
| RINSE | 2/1 | 115 | | |
| RINSE | 2/1 | 100 | | |
| SOUR | 4/1 | 85 | Acid Sour | 2 |
| LS EXTRACT | 3 | | | |
| SHAKEOUT | 1 | | | |

TABLE 8

| Industrial Wash Processes Using a Silicate Alkalinity Source | | | | |
|---|---|---|---|---|
| | (Op/Drain) | Silicate-Based Alkali | | |
| Operation | Time | Temp | Chemistry | Dose (oz/cwt) |
| BREAK | 7/1 | 150 | Silicate Based Alkali | 5-15 |
| CARRY OVER | 5/1 | 140 | Detergent | 7 |
| RINSE | 2/1 | 130 | | |
| RINSE | 2/1 | 115 | | |
| RINSE | 2/1 | 100 | | |
| SOUR | 4/1 | 85 | Acid Sour | 2 |
| LS EXTRACT | 3 | | | |
| SHAKEOUT | 1 | | | |

TABLE 9

| Hydroxide-Based Alkali | |
|---|---|
| Description | % |
| Soft Water | 5-15 |
| NaOH, 50% | 85-95 |

TABLE 10

| Silicate-Based Alkali | |
|---|---|
| Description | % |
| NaOH, 50% | 10-20 |
| Sodium Silicate 3.22 | 55-75 |
| Poly Acrylic Acid | 10-20 |
| DTPA, 40% | 0.5-5 |
| Soft Water | 1-10 |

Unsoiled, 100% polyester swatches available from wfk (30 A) were put through the wash process. A total of three swatches were removed after the drying cycle 0, 1, 3, and 5. After all washes were complete all of the swatches from each cycle were soiled with 0.1 g of dirty motor oil. The stain was allowed to wick overnight on a flat surface and washed the following day using the same wash process as before, except all swatches were washed using the median does of their respective alkalinity source (i.e. 14 oz/cwt caustic alkali or 10 oz/cwt silicate alkali). All swatches previously washed with a silicate alkali were again washed with a silicate containing alkali and vice versa with a caustic alkali. The percent of soil removal was calculated by measuring the reflectance of the soil on the swatches before and after wash on the spectrophotometer (ColorQuest XE, Hunter Associates Laboratory). The L* value is one of the color indices and is indicative of broad visible spectrum reflectance, where 100% is considered completely white. The percent soil removal was calculated using the aforementioned formula. Results of this test are shown in Table 11.

TABLE 11

| Percent soil removal of dirty motor oil after a series of washes using a soil release polymer in an industrial wash process using either a silicate or hydroxide-based alkali | | | | | |
|---|---|---|---|---|---|
| | % Soil Removal | | | | |
| | Hydroxide-Based Alkali | | Silicate-Based Alkali | | |
| Cycle # | 10 oz/cwt | 18 oz/cwt | 5 oz/cwt | 10 oz/cwt | 15 oz/cwt |
| 0 | 30.81 | 30.81 | 33.27 | 33.27 | 33.27 |
| 1 | 32.98 | 32.14 | 31.87 | 37.43 | 39.59 |
| 3 | 33.66 | 28.65 | 48.44 | 48.37 | 55.51 |
| 5 | 32.00 | 28.65 | 55.80 | 51.39 | 48.50 |
| % Change from 0 to 5 | 3.88 | −7.00 | 67.74 | 54.48 | 45.80 |

As shown in Table 11, the % soil removal is unchanged when the soil release polymer is used with a caustic alkali source; regardless of dose. The alkalinity carried over from the break step is too high for the soil release polymer to build up. This is in stark contrast to the use of soil release polymer with the silicate alkali. Here the soil removal improves with almost every cycle. The improvement in soil removal is essentially independent of the dose of silicate-based alkali. Regardless of dose with the silicate alkali, the soil release polymer builds up on the surface and dramatically improves the removal of oily soils from synthetic fabrics.

The inventions being thus described, it will be obvious that the same may be varied in many ways. Such variations are not to be regarded as a departure from the spirit and scope of the inventions and all such modifications are intended to be included within the scope of the following claims.

The above specification provides a description of the manufacture and use of the disclosed compositions and methods. Since many embodiments can be made without departing from the spirit and scope of the invention, the invention resides in the claims.

What is claimed is:

1. A method of cleaning an article, the method comprising:

(a) providing an article to be cleaned;

(b) contacting the article in a prewash step with a prewash composition comprising:

i) a soil release polymer;

ii) at least about 55 wt % alkali metal silicate as a source of alkalinity; and iii) water, wherein said prewash step is performed at a pH of about 7.5 to about 10.5, and wherein said prewash composition comprises less than 0.5 wt. % hydroxide-based alkalinity;

(c) contacting the article with an alkaline detergent in a main wash step wherein the alkaline detergent comprises a hydroxide-based alkalinity source;

(d) rinsing the article; and (e) contacting the article with an acid sour composition.

2. The method of claim 1, further comprising an additional alkalinity source, and wherein the additional alkalinity source is an alkanolamine, carbonate, or a combination thereof.

3. The method of claim 1, wherein the prewash composition further comprises one or more surfactants.

4. The method of claim 3, wherein the prewash composition further comprises an enzyme.

5. The method of claim 4, wherein the enzyme is a protease, amylase, or combination of protease and amylase.

6. A method of cleaning an article, the method comprising:

(a) providing an article to be cleaned;

(b) contacting the article in a prewash step with a prewash composition comprising:

i) a soil release polymer;

ii) at least about 55 wt % alkali metal silicate as a source of alkalinity; and iii) water, wherein said prewash step is performed at a pH of about 7.5 to about 10.5, and wherein said prewash composition comprises less than 0.5 wt. % hydroxide-based alkalinity;

(c) contacting the article with an alkaline detergent in a main wash step wherein said alkaline detergent has less than 0.5 wt. % hydroxide-based alkalinity;

(d) rinsing the article; and (e) contacting the article with an acid sour composition.

7. The method of claim 6, further comprising an additional alkalinity source, wherein the additional alkalinity source is an alkanolamine, carbonate, or a combination thereof.

8. The method of claim 1, wherein the prewash composition further comprises an enzyme, an enzyme stabilizer, a defoaming agent, a surfactant, or combinations thereof.

* * * * *